US005689216A

United States Patent [19]

Sturdivant

[11] Patent Number: 5,689,216

[45] Date of Patent: Nov. 18, 1997

[54] DIRECT THREE-WIRE TO STRIPLINE CONNECTION

[75] Inventor: Rick L. Sturdivant, Placentia, Calif.

[73] Assignee: Hughes Electronics, Los Angeles, Calif.

[21] Appl. No.: 625,956

[22] Filed: Apr. 1, 1996

[51] Int. Cl.[6] ..... H01P 5/08

[52] U.S. Cl. ..... 333/33; 333/260

[58] Field of Search ..... 333/33, 246, 260

[56] References Cited

U.S. PATENT DOCUMENTS 2,938,175 5/1960 Sommers et al. ..... 333/33
5,057,798 10/1991 Moye et al. ..... 333/33

*Primary Examiner*—Paul Gensler
*Attorney, Agent, or Firm*—Leonard A. Alkov; Wanda K. Denson-Low

[57] ABSTRACT

A transition for providing connection between a stripline transmission line which is buried in a substrate and the surface of the substrate where components are mounted. A three-wire line disposed orthogonally to the stripline is directly connected to the stripline. The center wire of the three-wire line is connected to the stripline center conductor strip, and the two ground wires are connected to the upper and lower ground planes of the stripline. The center wire of the three-wire line passes through an open area formed in the upper stripline ground plane. To improve the performance of the transition, mode conversion between the electric field configuration of stripline and the electric field configuration of three-wire line is provided, by terminating one ground wire at the upper stripline ground plane. The transition can be used to connect to a conductor-backed coplanar waveguide transmission line circuit formed on the substrate surface.

12 Claims, 3 Drawing Sheets

DIRECT THREE-WIRE TO STRIPLINE CONNECTION

TECHNICAL FIELD OF THE INVENTION

This invention relates to an electrical transition apparatus operable at microwave frequencies, and more particularly to an apparatus providing a direct transition from three-wire transmission line to stripline transmission line.

BACKGROUND OF THE INVENTION

Active radar array systems employ transmit/receive (T/R) modules which are connected to a respective radiating element. The modules typically employ stripline transmission lines operating at microwave frequencies, which can be buried in a multilayered substrate.

This invention permits the efficient connection of the buried stripline transmission line up to the surface of the substrate where components are mounted and transmission lines exist.

SUMMARY OF THE INVENTION

A transition from 3-wire line to stripline is described, and is particularly well suited for use in high density microwave modules, such as radar array transmit/receive (T/R) modules. This transition allows for the connection of stripline transmission line which is buried in a multi-layered substrate up to the surface of the substrate where components are mounted. This is accomplished by the direct connection of three-wire line. The transition allows for the vertical transition of the microwave signal on the stripline to be transitioned into three-wire line by using a special configuration which aids in the mode conversion, by adjusting the physical length and dimensions of the interface to the three-wire line. Mode conversion allows for the easy transfer of power from one transmission line type to another and therefore improves the performance. By reducing the radiation due to the three-wire line/stripline interface, reduced module coupling will result. Further, pass band ripple level will be reduced due to the improved return loss.

In accordance with the invention, a microwave circuit configuration includes a dielectric substrate, with a stripline transmission line buried in dielectric substrate below a surface of the substrate. The stripline transmission line comprises a stripline conductor strip, an electrically conductive lower ground plane, and an electrically conductive upper ground plane buried in the substrate between the stripline conductor strip and the substrate surface. A three-wire transmission line is connected to and extends transversely to the stripline transmission line. The three-wire line extends between the stripline transmission line and the substrate surface, the three-wire line comprising a first conductor wire connected to the stripline conductor strip, a second conductor wire connected to the upper and lower stripline ground planes and a third conductor wire connected to the upper and lower stripline ground planes. The upper ground plane has an open area formed therein to allow the first wire to extend through a plane defined by the upper ground plane without contacting the upper ground plane.

The three-wire line, according to a further aspect of the invention, connects to a conductor-backed coplanar waveguide (CBCPW) transmission line defined on the substrate surface. The first wire is electrically connected to the center conductor strip of the CBCPW line. The second wire is electrically connected to the first ground plane conductor strip of the CBCPW line. The third wire is electrically connected to the second ground plane conductor strip.

Mode conversion between the stripline transmission line and the three-wire transmission line is provided, in accordance with a further aspect of the invention, by terminating the second wire at the upper stripline ground plane, so that it does not extend between the upper and lower ground planes. As a result, the electric fields transition more smoothly at the interface between the stripline and the three-wire lines.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
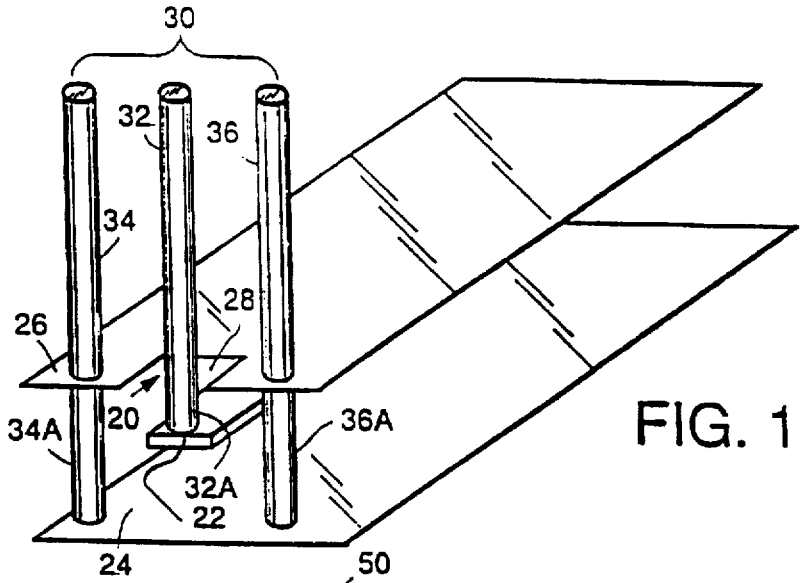
FIG. 1 is a simplified isometric view of a three-wire line to stripline connection in accordance with the invention.

One aspect of this invention is a transition which allows for the connection of stripline transmission line which is buried in a multi-layered substrate up to the surface of the substrate where components are mounted. This is accomplished by the direct connection of 3-wire transmission line. FIG. 1 illustrates a stripline transmission line 20 in a simplified, isometric view, wherein for simplicity the dielectric substrate in which the stripline is buried is not shown. The stripline includes a stripline center conductor 22 and upper and lower ground planes 26 and 24 which are spaced above and below the center conductor. In an exemplary implementation, the center conductor and ground planes are copper layers. To make the connection to the top of the dielectric substrate (not shown), an orthogonal three wire transmission line 30 is connected to the stripline transmission line. The line 30 includes a center wire 32 having a first end 32A connected to the center conductor 22 of the stripline. The line 30 further includes first and second ground wires 34 and 36 which are spaced from and disposed on opposite sides of the center wire. The ground wires extend through holes formed in the upper ground plane 26 and ends 34A and 36A terminate at the lower ground plane 24. The ground wires 34 and 36 thus are in electrical contact with both ground planes 26 and 24.

A preferred implementation technique will be cofired multilayer dielectric technology, well known in the art, wherein the wires, conductors and grounds are connected together during the firing process. However, other techniques can be used to connect the wires, such as solder, conductive epoxy resins, or any other connection technique which will conduct electricity.

The three-wire line 30 extends orthogonally to the stripline transmission line 20, to the top surface of the dielectric substrate. In order to allow the center wire 32 to extend to the stripline center conductor 22 without contacting the top ground plane 26, the ground plane is formed with a relieved area 28, through which the wire 32 extends.

Figure 2:
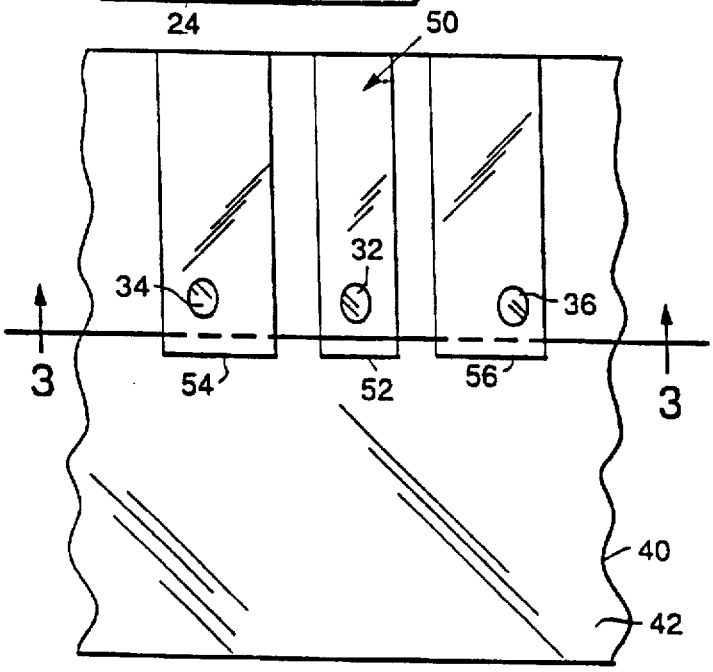
FIG. 2 is a top view of a dielectric substrate in which the stripline is buried, and to which the three-wire line is connected.

The three-wire line 30 extends up to the surface of the dielectric substrate to interconnect with other elements at the surface. For example, FIG. 2 is a top view of a dielectric substrate 40 in which the stripline 20 is buried, and to which the three-wire line 30 is connected. A conductor-backed coplanar waveguide (CBCPW) transmission line 50 is defined on the top surface 42 of the substrate, and includes a center conductor strip 52 and outer opposed ground plane strips 54 and 56. The ground plane 26 also serves as part of the CBCPW line comprising the conductors 52, 54 and 56. An end of the strip 52 is disposed over the end of the center wire 32 and makes contact with the wire 32. Similarly, the ground plane strips 54 and 56 are in respective electrical contact with ends of the outer wires 34 and 36.

Figure 3:
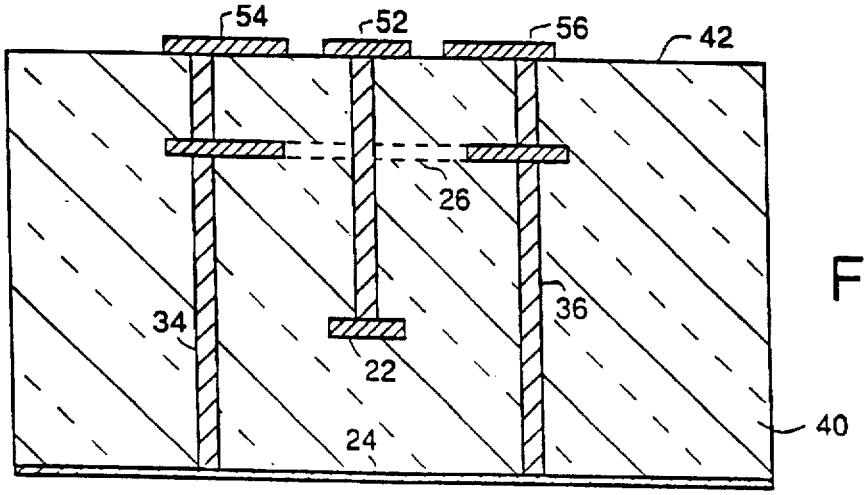
FIG. 3 is an end cross-sectional view of the circuit of FIG. 2, further illustrating the direct connection of the three-wire line 30 between the stripline 20 and a CBCPW transmission line.

FIG. 3 is an end cross-sectional view of the circuit of FIG. 2, further illustrating the direct connection of the three-wire line 30 between the stripline 20 and the CBCPW. In an exemplary implementation, the circuit can have the following nominal dimensions: wire diameter for the three-wire line, 0.008 inch; stripline center conductor width, 0.010 inch; width of the center conductor 52, 0.010 inch; gap between conductor 52 and the respective ground conductors 54, 56, 0.005 inch; depth of ground plane 26 below the substrate surface, 0.030 inch; depth of conductor 22 below ground plane 26, 0.025 inch; depth of ground plane 24 below conductor 22, 0.025 inch; and distance between wires 34 and 36, 0.056 inch. The depth of the buried ground plane 26 below the conductors 52, 54, 56 is selected to minimize the current present in it. The transition performance can be enhanced by minimizing the amount of current which exists in the buried ground plane 26.

Figure 4:
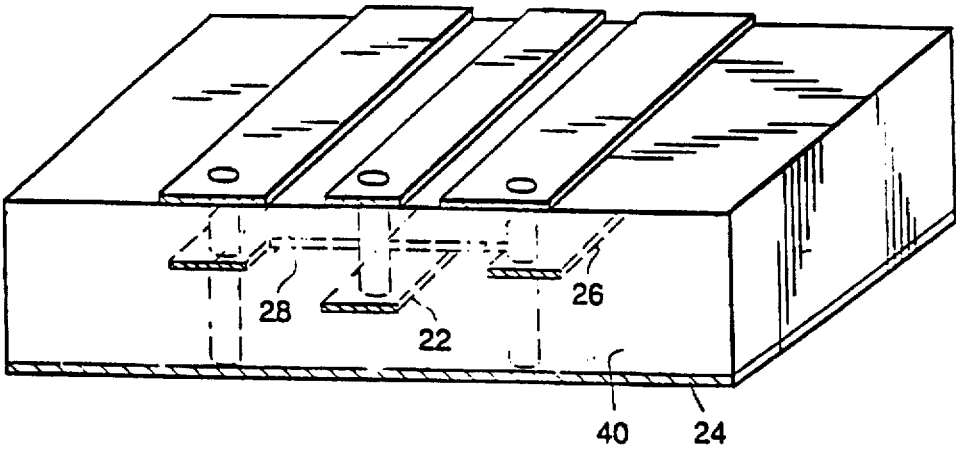
FIG. 4 is an isometric view of the circuit of FIG. 2, illustrating in further detail the open area formed in the buried ground plane to allow the center wire of the three-wire line to pass to the stripline conductor.

FIG. 4 is an isometric view of the circuit of FIG. 2, illustrating in further detail the open area 28 formed in the buried ground plane 26 to allow the center wire 32 of the three-wire line to pass to the stripline conductor 22.

The transition between the stripline transmission line 20 and the vertical three-wire transmission line 30 as illustrated in FIGS. 1–4 is accomplished without any mode conversion. Another aspect of this invention is a special configuration which aids in the mode conversion for the vertical transition of the microwave signal on the stripline into the three-wire line. The mode conversion is achieved by adjusting the physical length and dimensions of the interface to the three-wire line. The purpose of this transition is to allow for the lowest loss, lowest radiation, lowest return loss transition from the three-wire line to stripline. Mode conversion allows for the easy transfer of power from one transmission line type to another and therefore improves the performance. By reducing the radiation due to the three-wire line/stripline interface, reduced module coupling will result. Further, pass band ripple level will be reduced due to the improved return loss.

Figure 5A:
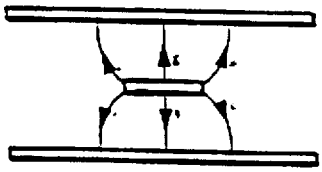
FIG. 5A shows an end view of a stripline transmission line, and its electric field configuration.
Figure 5B:
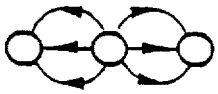
FIG. 5B shows an end view of a three-wire line and its electric field configuration.
Figure 5C:
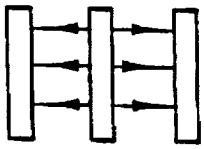
FIG. 5C is a side view of the three-wire line of FIG. 5B, showing the electric field configuration from a side view perspective.

To illustrate the mode conversion need, FIG. 5A shows an end view of a stripline transmission line, and its electric field configuration. FIG. 5B shows an end view of a three-wire line and its electric field configuration. FIG. 5C is a side view of the three-wire line of FIG. 5B, showing the electric field configuration from a side view perspective. It is the goal of the mode conversion aspect of this invention to provide a field transition between the field configurations of the two types of transmission lines which are connected together.

Figure 6:
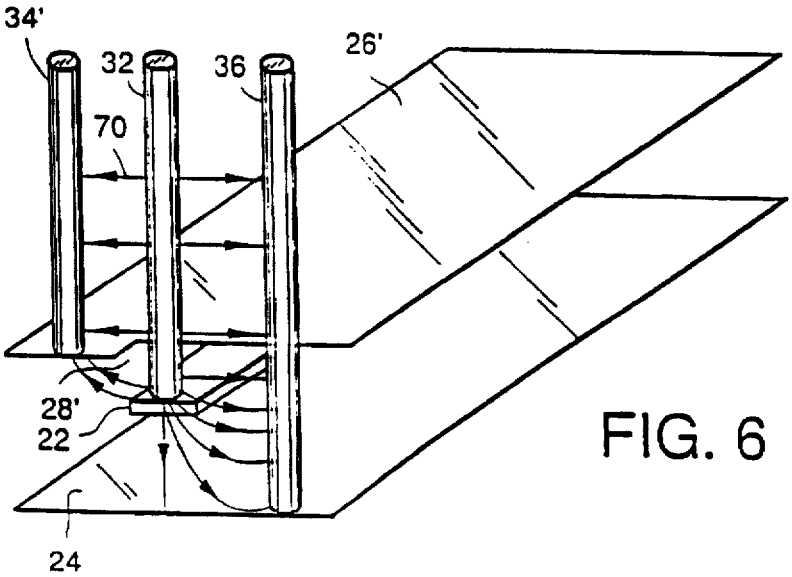
FIG. 6 is a simplified isometric view of a stripline-to-three wire line transition embodying mode conversion in accordance with the invention.

FIG. 6 is a simplified isometric view of a stripline-to-three wire line transition embodying mode conversion in accordance with the invention. The stripline includes the center conductor 22 and bottom ground plane 24 as in the embodiment of FIG. 1. In this example, the ground plane 26' differs from the ground plane 26 of FIG. 1, in that the open area 28' extends so that the ground wire 36 does not contact the ground plane 26'. The three-wire line is further modified, from the embodiment of FIG. 1, in that the ground wire 34' terminates at its junction with the upper ground plane 26', instead of passing through this ground plane to the second ground plane 24. The electric field configuration for this configuration of the transition is indicated by the field lines 70.

Figure 7:
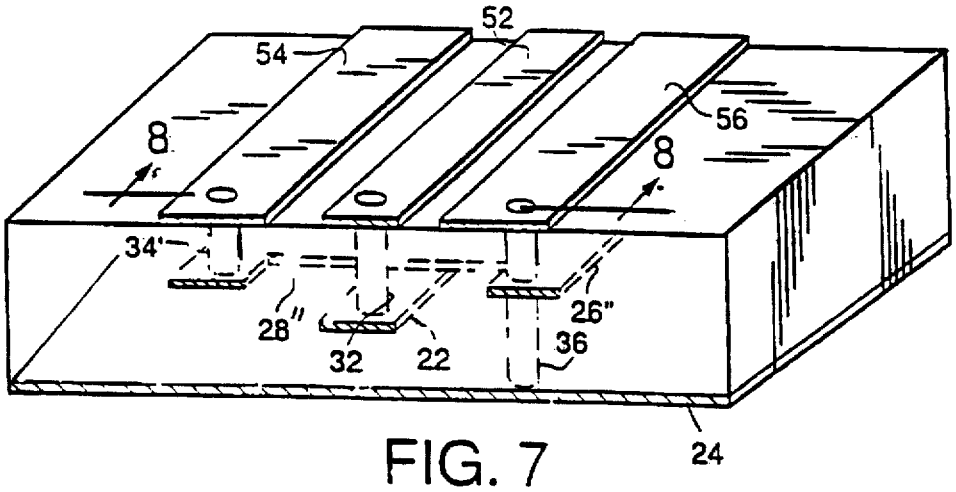
FIG. 7 is an isometric view of an alternate embodiment of a mode conversion connection of CBCPW to three-wire line to stripline.

FIG. 7 is an isometric view of an alternate embodiment of a mode conversion connection of CBCPW to three-wire line to stripline. The mode conversion structure is somewhat different from that of FIG. 6, in that the stripline ground plane 26" includes an open area 28" similar to that of the embodiment of FIG. 1, and in that the ground wire 36 makes electrical contact with the ground plane 26" in the same manner as illustrated in FIG. 1 and FIG. 4. This alternate configuration provides better performance at high frequencies of operation than the mode conversion embodiment of FIG. 6.

Figure 8:
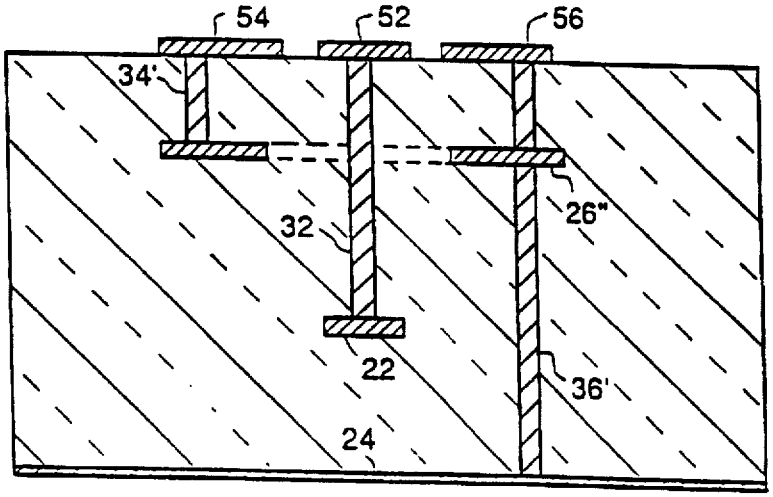
FIG. 8 is an end cross-sectional view taken along line 8—8 of FIG. 7.

FIG. 8 is an end cross-sectional view taken along line 8—8 of FIG. 7, showing the mode conversion connection of the CBCPW-to-three-wire-line-to stripline.

Figure 9:
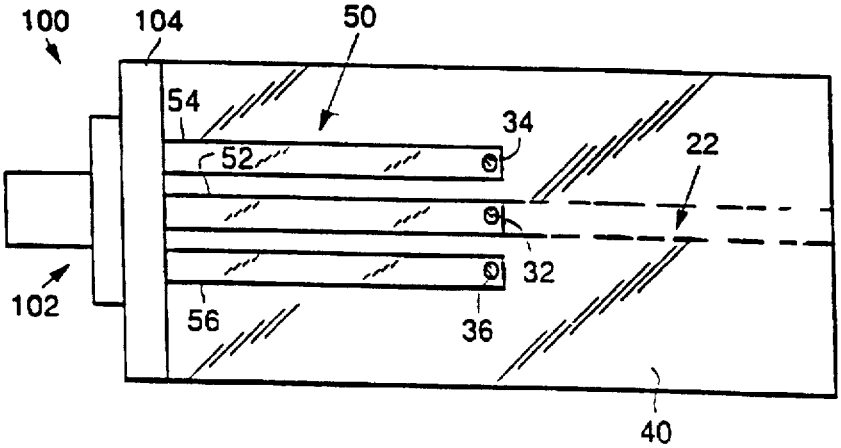
FIG. 9 is a simplified top view of an RF module employing a CBCPW-to-three-wire-line-to-stripline interconnect in accordance with the invention.

FIG. 9 is a simplified top view of an RF module 100 employing a CBCPW-to-three-wire-line-to-stripline interconnect in accordance with the invention. The module includes a coaxial connector 102 having a center conductor passing through an opening in the module housing wall 104, typically fabricated of aluminum or metal-plated plastic, to make contact with the center conductor strip 52 of the CBCPW line 50. The conductor strip 52 and ground conductor strips 54 and 56 are formed on the top surface of the dielectric substrate 40. The stripline center conductor strip 22 is illustrated in FIG. 9 for illustrative purposes, but is buried in the substrate. For clarity, the stripline ground planes are not shown in FIG. 9. The wires 32, 34 and 36 of the three-wire line are shown as well for illustrative purposes.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A microwave circuit comprising:

a dielectric substrate;

a stripline transmission line buried in said dielectric substrate below a surface of the substrate, said stripline transmission line comprising a stripline conductor strip, an electrically conductive lower ground plane, and an electrically conductive upper ground plane buried in said substrate between said stripline conductor strip and said substrate surface;

a three-wire transmission line connected to and extending transversely to said stripline transmission line and extending through said substrate between said stripline transmission line and said substrate surface, said three-wire line consisting of a first conductor wire connected to said stripline conductor strip, a second conductor wire connected to said upper and lower stripline ground planes and a third conductor wire connected to said upper and lower stripline ground planes; and wherein said upper ground plane has an open area formed therein to allow said first wire to extend through a plane defined by the upper ground plane without contacting the upper ground plane.

2. The circuit of claim 1 wherein said first, second and third wires of said three-wire transmission line extend orthogonally to said substrate surface.

3. The circuit of claim 1 wherein said first, second and third wires of said three-wire transmission line terminate at said substrate surface.

4. The circuit of claim 1 further comprising a conductor-backed coplanar waveguide (CBCPW) transmission line defined on said substrate surface, said CBCPW line comprising a center conductor strip defined on said surface and first and second ground conductor strips spaced from said center strip and defined on said surface, and wherein said first wire is electrically connected to said center conductor strip of said CBCPW line, said second wire is electrically connected to said first ground plane conductor strip of said CBCPW line, said third wire is electrically connected to said second ground plane conductor strip, and said upper ground plane also serves as a ground plane for said CBCPW transmission line.

5. The circuit of claim 4 wherein said upper and lower ground planes are parallel to each other and to said substrate surface.

6. A microwave circuit comprising:

a dielectric substrate;

a stripline transmission line buried in said dielectric substrate below a surface of the substrate, said stripline transmission line comprising a stripline conductor strip, an electrically conductive lower ground plane, and an electrically conductive upper ground plane buried in said substrate between said stripline conductor strip and said substrate surface;

a three-wire transmission line connected to and extending transversely to said stripline transmission line and extending between said stripline transmission line and said substrate surface, said three-wire line comprising a first conductor wire connected to said stripline conductor strip, a second conductor wire connected to and terminating at said upper stripline ground plane, and a third conductor wire connected to said lower stripline ground plane; and wherein said upper ground plane has an open area formed therein to allow said first wire to extend through a plane defined by the upper ground plane without contacting the upper ground plane.

7. The circuit of claim 6 wherein said first, second and third wires of said three-wire transmission line extend orthogonally to said substrate surface.

8. The circuit of claim 6 wherein said first, second and third wires of said three-wire transmission line terminate at said substrate surface.

9. The circuit of claim 6 further comprising a conductor-backed coplanar waveguide (CBCPW) transmission line defined on said substrate surface, said CBCPW line comprising a center conductor strip defined on said surface and first and second ground conductor strips spaced from said center strip and defined on said surface, and wherein said first wire is electrically connected to said center conductor strip of said CBCPW line, said second wire is electrically connected to said first ground plane conductor strip of said CBCPW line, said third wire is electrically connected to said second ground plane conductor strip, and said upper ground plane also serves as a ground plane for said CBCPW line.

10. The circuit of claim 9 wherein said upper and lower ground planes are parallel to each other and to said substrate surface.

11. The circuit of claim 6 wherein said third wire electrically connects to said upper ground plane as well as said lower ground plane.

12. The circuit of claim 6 wherein said third wire is not electrically connected to said upper ground plane, and said open area of said upper ground plane has a size sufficient to permit said first and third wires to pass through said plane without contacting said first ground plane.

* * * * *